US008656896B2

(12) United States Patent
Sasai et al.

(10) Patent No.: US 8,656,896 B2
(45) Date of Patent: Feb. 25, 2014

(54) CONTROL APPARATUS FOR INTERNAL COMBUSTION ENGINE AND CONTROL METHOD FOR INTERNAL COMBUSTION ENGINE

(75) Inventors: Mie Sasai, Susono (JP); Kazuhiro Wakao, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 471 days.

(21) Appl. No.: 13/095,374

(22) Filed: Apr. 27, 2011

(65) Prior Publication Data

US 2011/0264357 A1 Oct. 27, 2011

(30) Foreign Application Priority Data

Apr. 27, 2010 (JP) ..... 2010-101902

(51) Int. Cl.
*F02B 13/00* (2006.01)

(52) U.S. Cl.
USPC ..... 123/575; 123/1 A; 123/478

(58) Field of Classification Search
USPC ..... 123/1 A, 478, 480, 494, 575, 576, 577
See application file for complete search history.

(56) References Cited

U.S. PATENT DOCUMENTS

| | | | | |
|---|---|---|---|---|
| 5,934,255 | A | 8/1999 | Dalton et al. | |
| 7,983,831 | B2 * | 7/2011 | Tsunooka | 701/104 |
| 2012/0047992 | A1 * | 3/2012 | Sasai | 73/23.32 |

FOREIGN PATENT DOCUMENTS

| | | | |
|---|---|---|---|
| JP | 11315744 | A | 11/1999 |
| JP | 2002266712 | A | 9/2002 |
| JP | 2009133273 | A | 6/2009 |
| JP | 2011-111916 | A | 6/2011 |

* cited by examiner

*Primary Examiner* — John Kwon
(74) *Attorney, Agent, or Firm* — Gifford, Krass, Sprinkle, Anderson & Citkowski, P.C.

(57) ABSTRACT

A control apparatus for an internal combustion engine includes: a fuel property sensor which is provided between a fuel tank and a delivery pipe and which detects a component ratio of fuel; a fuel property value calculator that calculates an injector fuel property value for each cylinder using the component ratio detected by the fuel property sensor a period of time ago, which is equal to an amount of time required for the fuel to travel from the fuel property sensor to each fuel injector, as a value corresponding to the present component ratio of the fuel near the corresponding injector; and an engine-restart-time fuel injection amount calculator that calculates a fuel injection amount for each cylinder based on an engine-off duration in a case where the internal combustion engine is restarted after the internal combustion engine is stopped when the injector fuel property value varies from cylinder to cylinder.

7 Claims, 6 Drawing Sheets

CONTROL APPARATUS FOR INTERNAL COMBUSTION ENGINE AND CONTROL METHOD FOR INTERNAL COMBUSTION ENGINE

CROSS-REFERENCE TO RELATED APPLICATIONS

This application claims priority to Japanese Patent Application No. 2010-101902 filed on Apr. 27, 2010, which is incorporated herein by reference in its entirety including the specification, drawings, and abstract.

BACKGROUND OF THE INVENTION

1. Field of the Invention

The invention relates to a control apparatus for an internal combustion engine and a control method for an internal combustion engine.

2. Description of the Related Art

In an internal combustion engine that operates on blended fuel that contains a plurality of components, the fuel injection amount needs to be corrected based on the component ratio of the fuel. For example, in an internal combustion engine that operates on blended fuel that contains alcohol and gasoline, because the stoichiometric air-fuel ratio for alcohol and that for gasoline are values different from each other, a fuel injection amount corresponding to the concentration of alcohol in the fuel needs to be calculated in order to make the combustion air-fuel ratio equal to the stoichiometric air-fuel ratio. To this end, conventionally, a fuel property sensor that detects a component ratio, such as an alcohol concentration, is provided midway in a fuel supply passage through which fuel is supplied from a fuel tank to an internal combustion engine, and an appropriate fuel injection amount is calculated based on the component ratio detected by the fuel property sensor.

When a fuel tank is refueled with fuel having a different component ratio and thus the component ratio of the fuel in the fuel tank is changed, it is desirable that the fuel injection amount be changed at the time when the component ratio of the fuel that is injected from a fuel injector (hereinafter, referred to as "injection fuel") changes. In a returnless fuel system having no fuel return pipe for bringing fuel back to the fuel tank from the internal combustion engine, the rate at which fuel travels in the fuel supply passage changes depending on the amount of fuel consumed by the internal combustion engine. For this reason, the time period from when a change in the component ratio is detected by the fuel property sensor to when the component ratio of injection fuel actually changes varies depending upon the amount of fuel consumed by the internal combustion engine.

According to the technology described in Japanese Patent Application Publication No. 11-315744, a fuel passage from a fuel property sensor to a fuel injector is divided into a predetermined number of virtual cells, and information regarding the component ratio at each cell is stored. Each time fuel in an amount corresponding to the size of one cell is consumed by the internal combustion engine, the component ratio information at each cell is moved to the adjacent cell on the downstream side and the component ratio information detected by the fuel property sensor is stored in the most upstream cell. In this way, the component ratio of the injection fuel is estimated, and the fuel injection amount is calculated based on the estimated component ratio.

In an internal combustion engine provided with multiple fuel injectors at respective cylinders, the distance to each fuel injector measured along a fuel passage slightly varies from cylinder to cylinder. Therefore, when the component ratio of the fuel in the fuel tank changes, the component ratio of the injection fuel does not change simultaneously at all the cylinders, more specifically, the change in the component ratio of the injection fuel appears sequentially starting from the cylinder provided with the most upstream fuel injector in the fuel passage. Thus, before the component ratio of the injection fuel is completely changed to a new component ratio at all the cylinders, the component ratio of the injection fuel varies from cylinder to cylinder. In this state, if the internal combustion engine is stopped, the fuel near the fuel injector at each cylinder disperses and is mixed with the fuel near the fuel injector at the adjacent cylinder, and therefore the component ratio of the fuel is increasingly uniformized while the internal combustion engine is kept stopped. That is, the component ratio of the fuel near each fuel injector changes. Therefore, there is a possibility that the component ratio of the fuel that is actually injected from the fuel injector at each cylinder when the internal combustion engine is restarted will be different from the component ratio estimated before the internal combustion engine is stopped. As a result, the fuel injection amount may be excessive or insufficient, which adversely affects the engine startability, etc.

SUMMARY OF THE INVENTION

The invention provides a control apparatus and a control method for an internal combustion engine that is operable on blended fuel that contains a plurality of components, the control apparatus and the control method being used to prevent, even if the internal combustion engine is stopped while the component ratio of fuel is being changed, the amount of fuel that is injected when the internal combustion engine is restarted from becoming excessive or insufficient.

The first aspect of the invention relates to a control apparatus for an internal combustion engine operable on blended fuel that contains a plurality of components. The control apparatus includes: a delivery pipe through which the fuel is distributed to fuel injectors for multiple cylinders; a fuel supply passage through which the fuel is supplied to the delivery pipe from a fuel tank in which the fuel is stored; a fuel property sensor that is provided in the fuel supply passage, and that detects a component ratio of the fuel; a fuel property value calculator that calculates an injector fuel property value for each of the cylinders, the injector fuel property value being a value related to the component ratio of the fuel near each of the fuel injectors, using the component ratio detected by the fuel property sensor a period of time ago, which is equal to an amount of time required for the fuel to travel from the fuel property sensor to each of the fuel injectors, as a value corresponding to the present component ratio of the fuel near the corresponding injector; and an engine-restart-time fuel injection amount calculator that calculates a fuel injection amount for each of the cylinders based on an engine-off duration that is a time period from stop of the internal combustion engine to restart of the internal combustion engine, in a case where the internal combustion engine is restarted after the internal combustion engine is stopped when the injector fuel property value calculated by the fuel property value calculator varies from cylinder to cylinder.

According to the first aspect of the invention, even if the internal combustion engine is stopped while the component ratio of the fuel is being changed, the amount of fuel injected when the internal combustion engine is restarted can be appropriately calculated based on the component ratio at each of the cylinders by calculating the fuel injection amount for each of the cylinders based on the engine-off duration. Thus, the amount of fuel injected when the internal combustion engine is restarted can be reliability prevented from becoming excessive or insufficient, and thus good engine startability can be achieved.

In the first aspect, the engine-restart-time fuel injection amount calculator may include: an engine-restart-time fuel property value calculator that calculates the injector fuel property value for each of the cylinders at the restart of the internal combustion engine, based on the engine-off duration and the injector fuel property value for the corresponding cylinder, calculated before the internal combustion engine is stopped; and a fuel injection amount calculator that calculates the fuel injection amount for each of the cylinders based on the injector fuel property value for the corresponding cylinder at the restart of the internal combustion engine, calculated by the engine-restart-time fuel property value calculator.

With the configuration described above, the injector fuel property value for the each of the cylinders at the restart of the internal combustion engine can be more accurately calculated, and therefore the fuel injection amount for each of the cylinders, which is required at the restart of the internal combustion engine, can be more appropriately calculated.

In the configuration described above, the engine-restart-time fuel property value calculator may calculate the injector fuel property value for each of the cylinders at the restart of the internal combustion engine, based on the engine-off duration and a concentration diffusion duration that is a predetermined time period required for the fuel property value of the fuel in the delivery pipe to become uniform.

According to the configuration described above, the injector fuel property value for each of the cylinders at the restart of the internal combustion engine can be more accurately calculated.

In the configuration described above, there may be further provided a heater that heats the fuel in the fuel injectors or the fuel in the delivery pipe; an engine-restart-time heater activating unit that activates the heater to heat the fuel when the internal combustion engine is restarted; and a heating controller that controls an amount of heating performed by the heater when the internal combustion engine is restarted, based on the injector fuel property value for each of the cylinders at the restart of the internal combustion engine, calculated by the engine-restart-time fuel property value calculator.

According to the configuration described above, when the fuel in the fuel injectors or the fuel in the delivery pipe is heated by the heater at the restart of the internal combustion engine, an engine start problem due to excessive heating can be reliably prevented.

A second aspect of the invention relates to a method for controlling an internal combustion engine that is operable on blended fuel that contains a plurality of components, and that is provided with a delivery pipe through which the fuel is distributed to fuel injectors for multiple cylinders, a fuel supply passage through which the fuel is supplied to the delivery pipe from a fuel tank in which the fuel is stored, and a fuel property sensor that is provided in the fuel supply passage and that detects a component ratio of the fuel. The method includes: calculating an injector fuel property value for each of the cylinders, the injector fuel property value being a value related to the component ratio of the fuel near each of the fuel injectors, using the component ratio detected by the fuel property sensor a period of time ago, which is equal to an amount of time required for the fuel to travel from the fuel property sensor to each of the fuel injectors, as a value corresponding to the present component ratio of the fuel near the corresponding injector; and calculating a fuel injection amount for each of the cylinders based on an engine-off duration that is a time period from stop of the internal combustion engine to restart of the internal combustion engine, in a case where the internal combustion engine is restarted after the internal combustion engine is stopped when the calculated injector fuel property value varies from cylinder to cylinder.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF THE EMBODIMENTS

Hereafter, an example embodiment of the invention will be described with reference to the accompanying drawings. Note that, like elements will be denoted by like numerals, and the description thereof will not be repeated.

Figure 1:
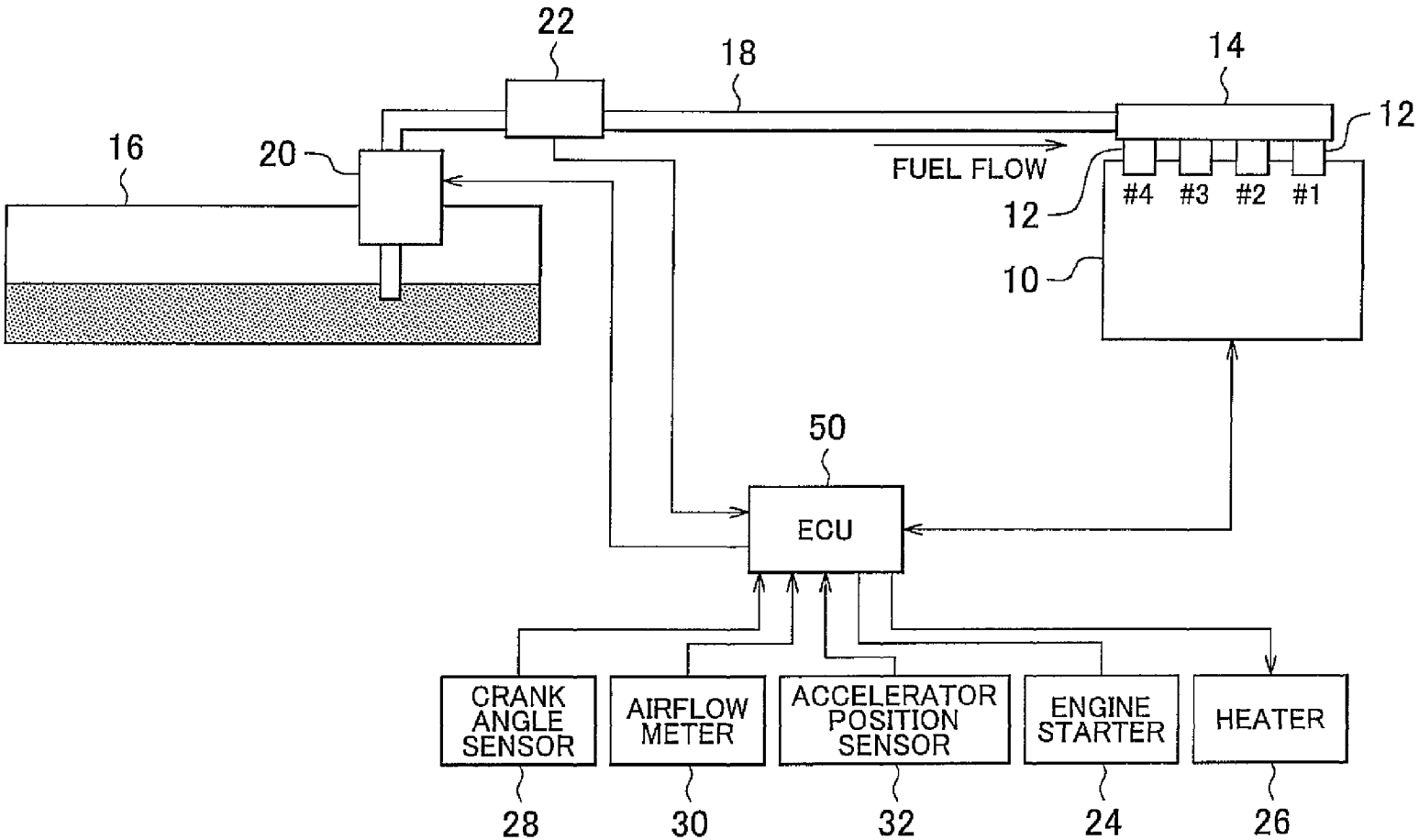
FIG. 1 is a view illustrating the structure of a system according to an example embodiment of the invention.

FIG. 1 illustrates the structure of a system according to the example embodiment of the invention. The system includes an internal combustion engine 10 (will hereinafter be referred to as "engine 10") mounted in a vehicle and an ECU (Electronic Control Unit) 50 used to control the operation of the engine 10. The engine 10 is operable on blended fuel that contains a plurality of components (note that blended fuel that contains ethanol and gasoline is used in the example embodiment), and in particular, the engine 10 is operable on blended fuel having a given component ratio (note that an ethanol concentration is used as the component ratio in the example embodiment). The engine 10 in the example embodiment is an in-line four-cylinder engine that includes cylinders #1 to #4. However, it is to be noted that the number of cylinders and the cylinder layout are not limited to them. Fuel injectors 12 are provided at the respective cylinders #1 to #4 and inject fuel into intake ports for the respective cylinders #1 to #4 or into the respective cylinders #1 to #4. The fuel injectors 12 at the cylinders #1 to #4 are connected to a common delivery pipe 14. Further, intake valves, exhaust valves, ignition plugs, etc., are provided at the respective cylinders #1 to #4.

A fuel tank 16 may be refueled with fuel having a given ethanol concentration, which is selected by a user. The fuel stored in the fuel tank 16 is pumped up and pressurized by a fuel pump 20, and then delivered to the delivery pipe 14 via a fuel pipe 18. Then, the fuel is finally distributed to the fuel injectors 12 at the respective cylinders #1 to #4 from the delivery pipe 14. A fuel property sensor 22 is provided midway in the fuel pipe 18, and detects the ethanol concentration in the fuel. The type of the fuel property detection by the fuel property sensor 22 is not limited to any specific one. For example, the fuel property sensor 22 may be a fuel property sensor that measures the capacitance between electrodes provided such that fuel is present therebetween, or may be a fuel property sensor that measures the light transmissivity (absorbance) of fuel. That is, the fuel property sensor 22 may be of any fuel property detection type. The fuel property sensor 22 is electrically connected to the ECU 50.

The system according to the example embodiment further includes an engine starter 24 for starting the engine 10, a heater 26 for heating fuel when the engine 10 is started at a low temperature, and a sensor system including the following sensors. A crank angle sensor 28 outputs a signal synchronized with the rotation of a crankshaft of the engine 10. The ECU 50 determines the engine speed and the crank angle based on the output from the crank angle sensor 28. An airflow meter 30 detects the amount of air taken into the engine 10 (intake air amount). An accelerator position sensor 32 detects the amount by which an accelerator pedal is operated by a driver of the vehicle.

In addition to the sensors described above, the sensor system includes various other sensors required to control the vehicle and the engine 10 (e.g., a coolant temperature sensor that detects the engine coolant temperature). These sensors are connected to the input side of the ECU 50. Various actuators including the above-described fuel injectors 12, ignition plugs, fuel pump 20, etc., are connected to the output side of the ECU 50.

The ECU 50 obtains information regarding the operation of the engine 10 using the sensor system and controls the operation of the engine 10 by activating or driving the respective actuators based on the information obtained. More specifically, the ECU 50 determines the engine speed and the crank angle based on the output from the crank angle sensor 28. Further, the ECU 50 calculates the fuel injection amount based on the engine speed, the ethanol concentration in the fuel, and the in-cylinder air amount calculated from the value detected by the airflow meter 30, etc. Subsequently, the ECU 50 determines the fuel injection timing, ignition timing, etc., and then activates the fuel injectors 12 and the ignition plugs.

For example, when the engine 10 is controlled using the stoichiometric air-fuel ratio as the target air-fuel ratio, the fuel injection amount may be calculated by dividing the in-cylinder air amount by the stoichiometric air-fuel ratio. However, since the stoichiometric air-fuel ratio for ethanol and that for gasoline are different from each other, the stoichiometric air-fuel ratio for blended fuel that contains ethanol and gasoline varies depending on the ethanol concentration in the fuel. For this reason, the amount of fuel that needs to be injected to make the actual air-fuel ratio equal to the stoichiometric air-fuel ratio varies depending upon the ethanol concentration in the fuel. For this reason, the ECU 50 calculates the fuel injection amount required to make the actual air-fuel ratio equal to the target air-fuel ratio, based on the ethanol concentration in the fuel that is injected from each fuel injector 12.

A fuel supply system according to the example embodiment is a returnless fuel supply system having no fuel return pipe for bringing the fuel back to the fuel tank 16 from the delivery pipe 14. Therefore, as the fuel is consumed by the engine 10, the fuel in the fuel pipe 18 travels toward the engine 10 at the rate corresponding to the amount of fuel consumed by the engine 10. When the fuel tank 16 is refueled with fuel having a different ethanol concentration and therefore the ethanol concentration in the fuel in the fuel tank 16 changes, the ethanol concentration detected by the fuel property sensor 22 (will hereinafter be referred to as "sensor ethanol concentration") changes at the time when the fuel that is newly supplied to the fuel tank 16 (will hereinafter be referred to as "post-refueling fuel") reaches the fuel property sensor 22. At this time, however, the fuel that is pumped up from the fuel tank 16 after refueling the fuel tank 16 with the fuel having different ethanol concentration has not yet reached the fuel injectors 12 at the respective cylinders #1 to #4, and therefore the ethanol concentration in the injection fuel has not yet changed.

Figure 2:
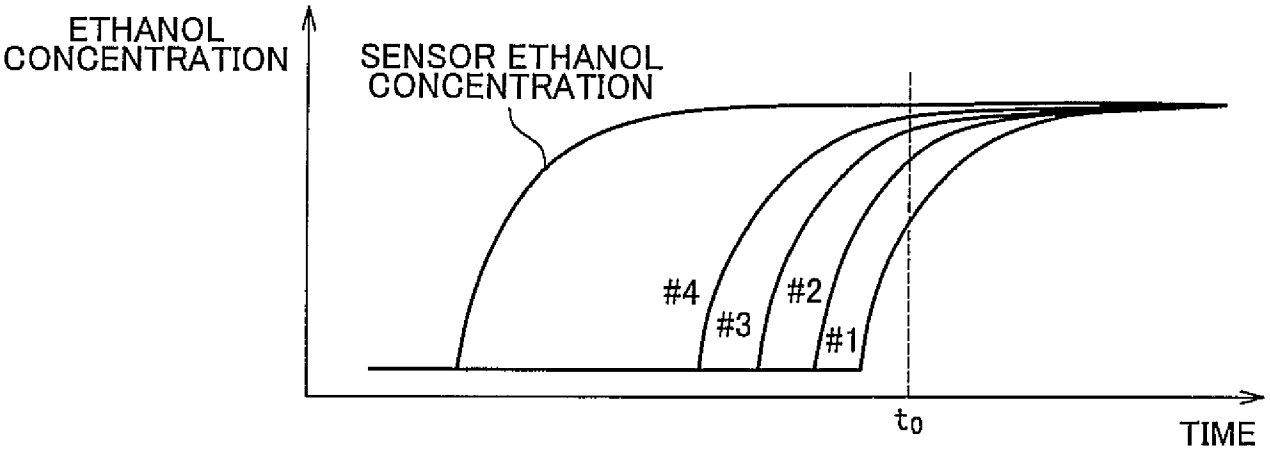
FIG. 2 is a graph illustrating how the ethanol concentration in the injection fuel changes at each cylinder after fuel having a different ethanol concentration is supplied.

The graph of FIG. 2 illustrates how the sensor ethanol concentration and the ethanol concentration in the injection fuel at each of the cylinders #1 to #4 change while the engine 10 is operating after the fuel tank 16 is refueled with fuel having a different ethanol concentration. Note that FIG. 2 illustrates an example where fuel having a high ethanol concentration is supplied to the fuel tank 16 in which fuel having a low ethanol concentration is left. The greater the length of the portion of the fuel pipe 18 between the fuel property sensor 22 and the delivery pipe 14, the longer the time required for the fuel to travel from the fuel property sensor 22 to the delivery pipe 14. For this reason, as shown in FIG. 2, there is a time lag between when the sensor ethanol concentration is changed and when the ethanol concentration in the injection fuel changes. Further, as shown in FIG. 1, in the example embodiment, the fuel pipe 18 is connected to the cylinder #4-side end of the delivery pipe 14. Therefore, the post-refueling fuel first reaches the fuel injector 12 at the cylinder #4, and then reaches the fuel injector 12 at the cylinder #3, the fuel injector 12 at the cylinder #2, and the fuel injector 12 at the cylinder #1 in this order. Therefore, as shown in FIG. 2, a change in the ethanol concentration in the injection fuel appears first at the cylinder #4, and then appears at the cylinder #3, the cylinder #2, and the cylinder #1 in this order.

As mentioned above, when the ethanol concentration in the fuel changes, the ethanol concentration in the injection fuel is not simultaneously changed at all the cylinders #1 to #4, but changes at the cylinders #1 to #4 at different times. For this reason, in order to correct the fuel injection amount more appropriately when the ethanol concentration in the fuel changes, preferably, the fuel injection amount should be corrected based on the ethanol concentration at each cylinder at the time when the ethanol concentration changes at the cylinder. In the example embodiment, the ethanol concentration detected by the fuel property sensor 22 is used as the present ethanol concentration in the fuel near the fuel injector 12 at each cylinder (hereinafter, referred to as "injector ethanol concentration"). The ethanol concentration used is the ethanol concentration detected by the fuel property sensor 22 a period of time ago, which is equal to the amount of time required for the fuel to travel from the fuel property sensor 22 to the corresponding fuel injector 12. The injector ethanol concentration at each cylinder is calculated, and the fuel injection amount for each cylinder is calculated based on the injector ethanol concentration at the corresponding cylinder.

Figure 3:
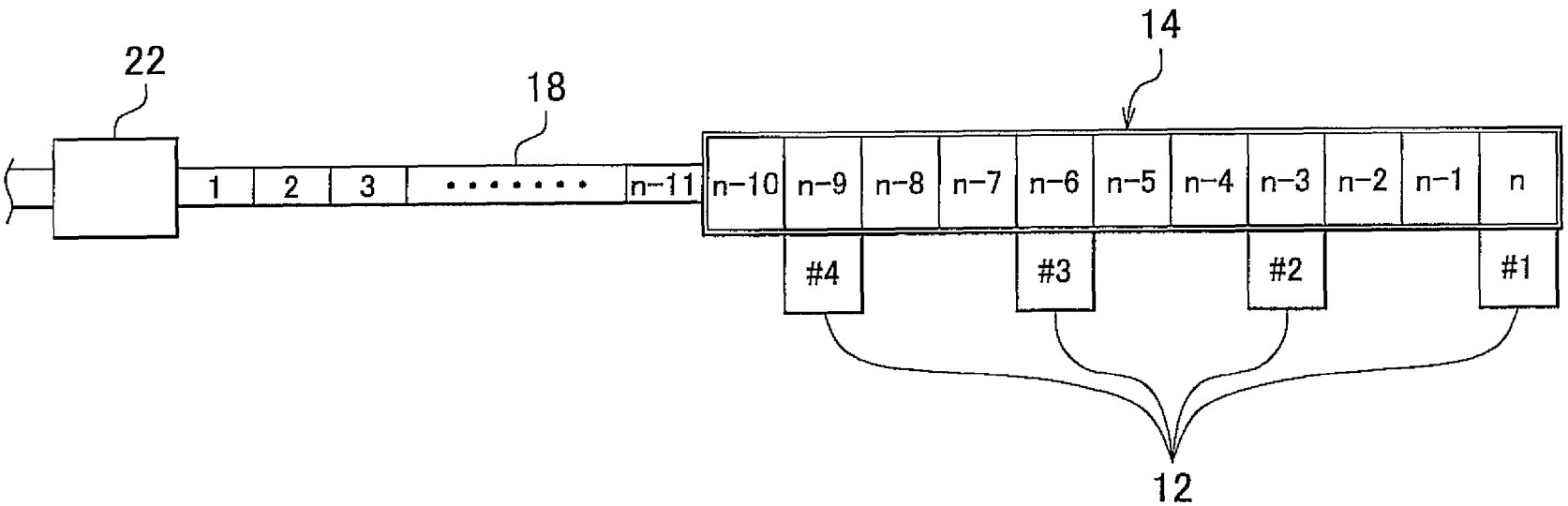
FIG. 3 is a view illustrating an example where a fuel passage from a fuel property sensor to a fuel injector at the cylinder most distant from the fuel property sensor is divided into n virtual cells.

More specifically, in the example embodiment, the injector ethanol concentration at each cylinder is calculated as follows. The fuel passage from the fuel property sensor 22 to the fuel injector 12 at the cylinder most distant from the fuel property sensor 22 is divided into a predetermined number (will hereinafter be referred to as "n") of virtual cells, and the ethanol concentration at each cell is stored. As shown in FIG. 3, in the example embodiment, the fuel passage from the fuel property sensor 22 to the fuel injector 12 at the cylinder most distant from the fuel property sensor 22 is divided into n cells. As shown in FIG. 3, in the example embodiment, the interior of the portion of the fuel pipe 18 from the fuel property sensor 22 to the delivery pipe 14 is divided into (n−11) cells, and the interior of the delivery pipe 14 is divided into 11 cells. In the following description, the cells are denoted by the numerals indicated in FIG. 3. Each time the fuel in the amount corresponding to the size of one cell is consumed by the engine 10, the ethanol concentration stored in each cell is moved to the adjacent cell on the downstream side, and the ethanol concentration that is detected by the fuel property sensor 22, that is, the sensor ethanol concentration is stored in the cell 1 adjacent to the fuel property sensor 22.

In the example embodiment, as described above, the time at which the injector ethanol concentration changes can be precisely predicted. The time at which the injector ethanol concentration changes varies from cylinder to cylinder. Therefore, the fuel injection amount for each cylinder can be appropriately calculated. That is, when the ethanol concentration in the fuel changes, even if the fuel injection amount required to achieve the target air-fuel ratio varies from cylinder to cylinder, the appropriate fuel injection amount for each cylinder can be accurately calculated. Therefore, the air-fuel ratio in each cylinder can be accurately controlled.

The following description will be made on the assumption that the engine 10 is stopped at a time at which the injector ethanol concentration varies from cylinder to cylinder, such as time $t_0$ in FIG. 2. At this time, there is an ethanol concentration gradient in the fuel in the delivery pipe 14. For example, referring to the case illustrated in FIG. 2, the ethanol concentration decreases from the cylinder #4-side end toward the cylinder #1-side end of the delivery pipe 14. When the engine 10 is not operating, the ethanol concentration in the delivery pipe 14 is gradually reduced due to concentration diffusion. For this reason, if a time period from the stop of the engine 10 to the restart of the engine 10 (hereinafter, referred to as "engine-off duration") is longer than a predetermined value, the injector ethanol concentration at each cylinder at the restart of the engine 10 differs from that at the stop of the engine 10. Accordingly, if the fuel injection amount at each cylinder at the restart of the engine 10 is calculated based on the injector ethanol concentration at the stop of the engine 10, the fuel injection amount may be excessive or insufficient due to the difference between the injector ethanol concentration at the stop the engine 10 and the actual injector ethanol concentration. This may adversely affect the engine startability, emissions, etc.

Figure 4:
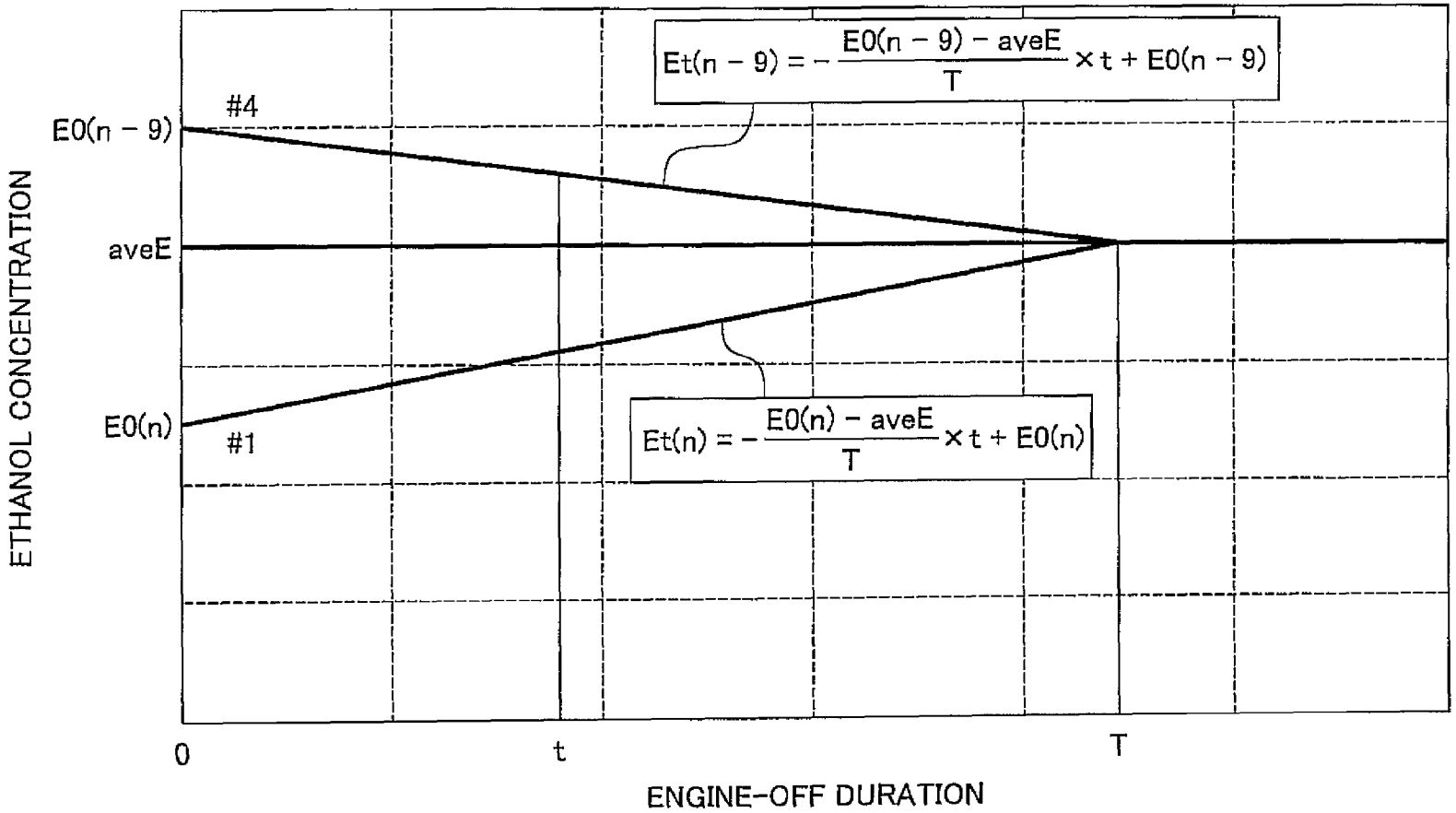
FIG. 4 is a graph illustrating a method for estimating the ethanol concentration at each injector at restart of an engine.

In order to solve the problem mentioned above, in the example embodiment, the injector ethanol concentration at each cylinder at the restart of the engine 10 (will hereinafter be referred to as "engine-restart-time injector ethanol concentration" where appropriate) is estimated based on the engine-off duration, and the fuel injection amount for the cylinder is calculated based on the estimated injector ethanol concentration. The graph in FIG. 4 illustrates a method for estimating the engine-restart-time injector ethanol concentration. In the following description, "time 0" represents the time at which the engine 10 is stopped, and "time t" represents the time at which the engine 10 is restarted, that is, "t" represents the engine-off duration. Further, "E0(*i*)" represents the ethanol concentration at the cell denoted by the number "i" at time 0, and "Et(i)" represents the ethanol concentration at the cell denoted by the number "i" at time t.

As shown in FIG. 2, the injector ethanol concentration at the cylinder #4 corresponds to the ethanol concentration at the cell (n-9), and the injector ethanol concentration at the cylinder #1 corresponds to the ethanol concentration at the cell (n).

As shown in FIG. 4, at the time at which the engine 10 is stopped (time 0), there is an ethanol concentration gradient in the fuel in the delivery pipe 14, and the injector ethanol concentration E0(*n*-9) at the cylinder #4 is higher than the injector ethanol concentration E0(*n*) at the cylinder #1. However, the ethanol concentration in the delivery pipe 14 becomes increasingly uniformized with time, and finally uniformized completely. The time required for the ethanol concentration in the delivery pipe 14 to become uniform due to concentration diffusion, that is, the time required to eliminate the ethanol concentration gradient in the fuel in the delivery pipe 14 will hereinafter be referred to as "concentration diffusion duration" and denoted by "T". The concentration diffusion duration T is a constant that varies depending upon the volumetric capacity and shape of the delivery pipe 14, and can be measured in advance. The ethanol concentration that is achieved when the concentration gradient in the delivery pipe 14 is eliminated and the ethanol concentration in the delivery pipe 14 becomes uniform (will hereinafter be referred to as "aveE" where necessary) may be calculated as the average value of the ethanol concentration in the delivery pipe 14 at the time when the engine 10 is stopped (time 0).

When the engine-off duration t is equal to or longer than the concentration diffusion duration T, the ethanol concentration in the fuel in the delivery pipe 14 is uniform, and therefore the engine-restart-time injector ethanol concentration at each of all the cylinders is equal to aveE.

On the other hand, if the engine-off duration t is shorter than the concentration diffusion duration T, the injector ethanol concentration still varies from cylinder to cylinder when the engine 10 is restarted. In this case (t<T), as shown in FIG. 4, the injector ethanol concentration Et(n-9) at the cylinder #4 and the injector ethanol concentration Et(n) at the cylinder #1 at the restart of the engine 10 (time t) may be calculated by the following equations, respectively.

$$Et(n-9)=-\{E0(n-9)-aveE\}/T\times t+E0(n-9) \quad \text{Equation 1}$$

$$Et(n)-\{E0(n)-aveE\}/T\times t+E0(n) \quad \text{Equation 2}$$

Note that the injector ethanol concentration Et(n-6) at the cylinder #3, the injector ethanol concentration Et(n-3) at the cylinder #2, and the ethanol concentration at another cell in the delivery pipe 14 may be calculated in the same manner as indicated above.

Figure 5:
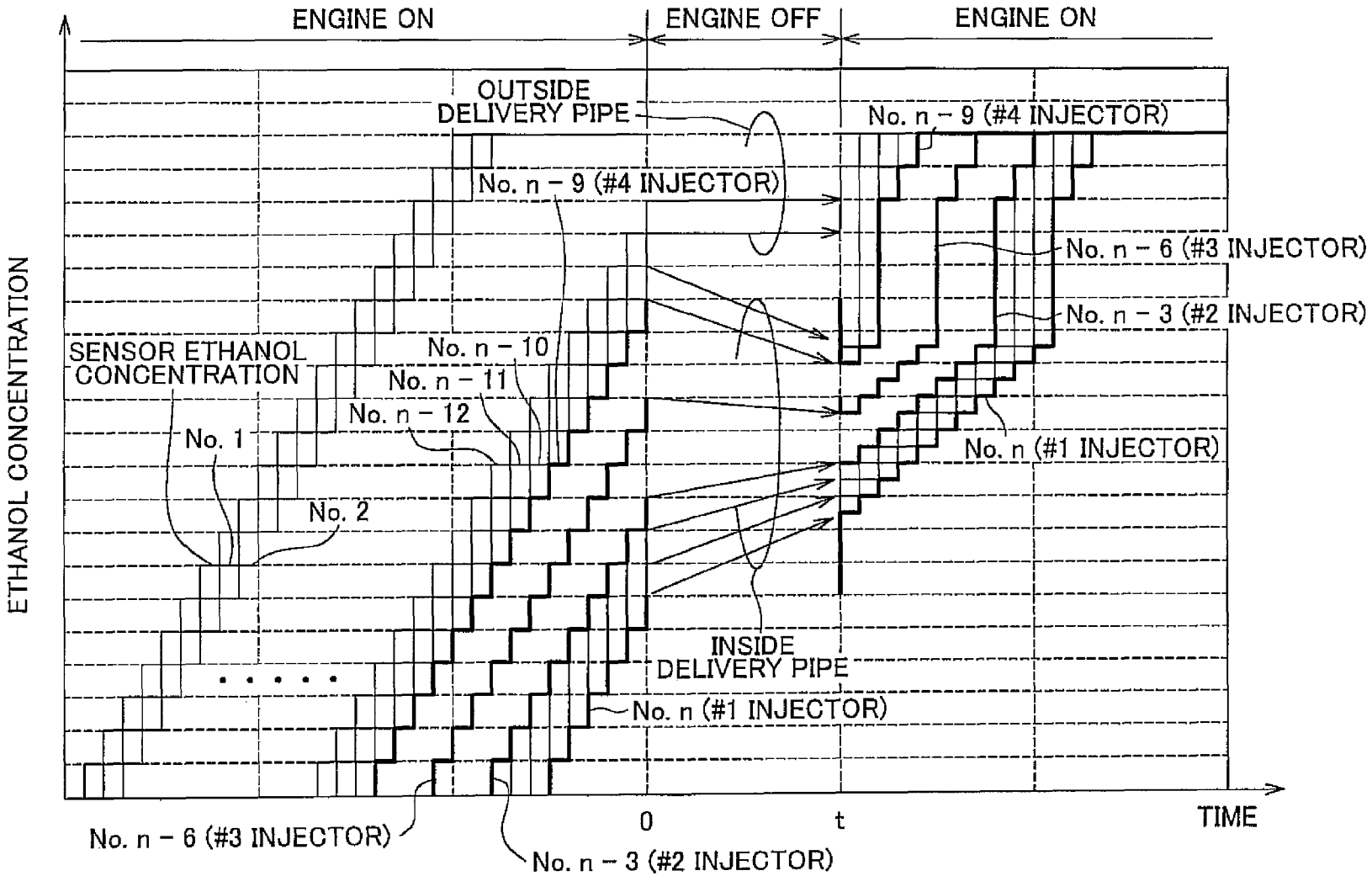
FIG. 5 is a graph illustrating an example of how the calculated value of the ethanol concentration in each cell changes in the example embodiment of the invention.

The graph in FIG. 5 illustrates an example of how the calculated ethanol concentration at each cell changes in the example embodiment. More specifically, the graph in FIG. 5 illustrates a case where the engine 10 is stopped when the injector ethanol concentration varies from cylinder to cylinder, that is, when there is an ethanol concentration gradient in the fuel in the delivery pipe 14, and the engine 10 is restarted when the engine-off duration t is still shorter than the concentration diffusion duration T. As shown in FIG. 5, when the engine 10 is not operating, due to concentration diffusion, the ethanol concentration at each of the cells (n-10) to (n) that correspond to the cells in the delivery pipe 14, including the injector ethanol concentration at each cylinder, becomes increasingly uniformized, and gradually approaches the average ethanol concentration aveE. On the other hand, since the cross-sectional passage area of the fuel pipe 18 is sufficiently small, it is considered that concentration diffusion does not occur in the fuel pipe 18 even when the engine 10 is not operating. Thus, in the example embodiment, even if the ethanol concentration varies from cell to cell outside the delivery pipe 14 when the engine 10 is stopped, the ethanol concentration at each cell at the stop of the engine 10 is regarded as being maintained until the engine 10 is restarted. That is, in the example embodiment, as shown in FIG. 5, the ethanol concentration at each of the cells 1 to (n-11), which are outside the delivery pipe 14, is regarded as being maintained at the value detected when the engine 10 is stopped, until the engine 10 is restarted. In this way, the ethanol concentration at each cell at the restart of the engine 10 is determined. After the engine 10 is restarted, the injector ethanol concentration at each cylinder can be calculated by updating the ethanol concentration at the cell in the same manner as that used before the engine 10 is stopped.

Figure 6:
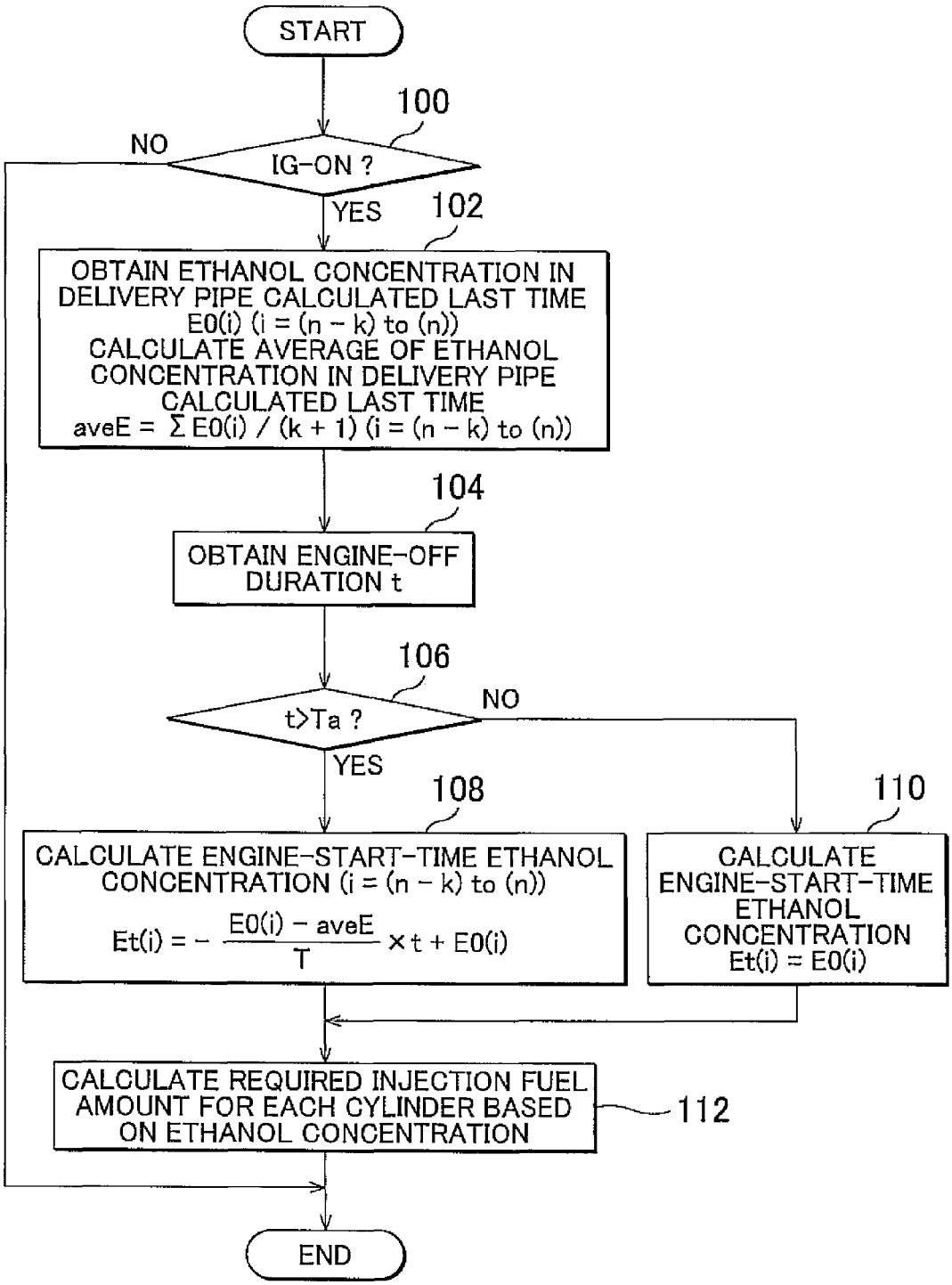
FIG. 6 is a flowchart of a routine executed in the example embodiment of the invention.

The flowchart in FIG. 6 illustrates the routine that the ECU 50 executes to realize the above-described functions in the example embodiment. It is to be noted that "k" in FIG. 6 is 10 in the case of the fuel passage division illustrated in FIG. 3 (k=10).

In the routine illustrated in FIG. 6, first, it is determined whether a request to restart the engine 10 has been issued (Step 100). If it is determined that a request to restart the engine 10 has been issued, the ethanol concentration E0(*i*) at each of the eleven cells in the delivery pipe 14, that is, the cells (n-10) to (n), which is calculated immediately before the engine 10 is stopped last time, is obtained, and then the average value aveE of the ethanol concentration is calculated (Step 102).

Next, the engine-off duration t is obtained (Step 104). Subsequently, the obtained engine-off duration t is compared with a predetermined value Ta (Step 106). If the engine-off duration t is sufficiently short, the amount by which the ethanol concentration is changed due to concentration diffusion while the engine 10 is not operating is small, and it is therefore not necessary to correct the engine-restart-time fuel injection amount with the concentration diffusion taken into account. The predetermined value Ta is a prescribed value that is used to determine whether the engine-off duration t is so short that it is unnecessary to correct the engine-restart-time fuel injection amount.

If it is determined in Step 106 that the engine-off duration t is longer than the predetermined value Ta, it is determined that the engine-restart-time fuel injection amount needs to be corrected. In this case, therefore, the ethanol concentration Et(i) at each cell in the delivery pipe 14 at the restart of the engine 10 is calculated by following equation (Step 108).

$$Et(i)=-\{E0(i)-aveE\}/T\times t+E0(i) \qquad \text{Equation 3}$$

Here, i=(n-10) to (n)

Among the ethanol concentrations Et(i) at the respective cells in the delivery pipe 14 at the restart of the engine 10, which are calculated in Step 108, Et(n-9) corresponds to the engine-restart-time injector ethanol concentration at the cylinder #4, Et(n-6) corresponds to the engine-restart-time injector ethanol concentration at the cylinder #3, Et(n-3) corresponds to the engine-restart-time injector ethanol concentration at the cylinder #2, and Et(n) corresponds to the engine-restart-time injector ethanol concentration at the cylinder #1. Thus, when Step 108 is executed, the required engine-restart-time fuel injection amount for each cylinder is calculated based on the engine-restart-time injector ethanol concentration at the cylinder (Step 112).

However, if the engine-off duration t is longer than the concentration diffusion duration T, the injector ethanol concentration at each of all the cylinders is equal to the average value aveE, and therefore the average value aveE is assigned to the engine-restart-time injector ethanol concentration at each of all the cylinders in Step 108.

On the other hand, if it is determined in Step 106 that the engine-off duration t is equal to or shorter than the predetermined value Ta, it is determined that the engine-restart-time fuel injection amount need not be corrected. In this case, the ethanol concentration Et(i) at each cell at the restart of the engine 10 may be regarded as being equal to the ethanol concentration E0(*i*) at the cell at the stop of the engine 10. In this case, therefore, the ethanol concentration E0(*i*) at each cell at the stop of the engine 10 is assigned to the ethanol concentration Et(i) at the cell at the restart of the engine 10, and then the engine-restart-time fuel injection amount for the corresponding cylinder is calculated (Step 112).

As described above, in the example embodiment, when the engine-off duration t is sufficiently short, that is, when the engine-off duration t is equal to or shorter than the predetermined value Ta, the engine-restart-time fuel injection amount is not corrected. A configuration may be employed in which the engine-restart-time fuel injection amount is not corrected also when the ethanol concentration gradient in the fuel in the delivery pipe 14 is sufficiently small at the stop of the engine 10. This is because the variation in the required fuel injection amount from cylinder to cylinder is small if the ethanol concentration gradient in the fuel in the delivery pipe 14 is sufficiently small at the stop of the engine 10, and therefore the engine 10 can be properly restarted without correcting the fuel injection amount.

If fuel having a high ethanol concentration is used, when the engine is started at a low temperature, vaporization of injected fuel is relatively sluggish. In view of this, the heater 26 that heats the fuel in the fuel injectors 12 or the fuel in the delivery pipe 14 may be provided to raise the fuel temperature and thus facilitate the vaporization of injected fuel when the engine 10 is started.

However, when fuel having a low ethanol concentration is used, that is, when fuel containing a gasoline component at a high ratio is used, if the fuel is heated using the heater 26 in the same manner as that when fuel having a high ethanol concentration is used, there is a possibility of excessive heating of the fuel, which may produce bubbles in the fuel. This may impede proper fuel injection, and finally cause an engine start problem. For this reason, it is desirable that the amount of heating by the heater 26 be controlled to an appropriate amount corresponding to the ethanol concentration, based on the engine-restart-time injector ethanol concentration. According to the above-described method in the example embodiment, it is possible to accurately estimate the engine-restart-time injector ethanol concentration at each cylinder. Thus, the amount of heating by the heater 26 can be appropriately controlled based on the ethanol concentration in the fuel near each fuel injector 12, and therefore an engine start problem due to excessive heating of fuel can be reliably prevented.

More specifically, if the heater 26 is provided for each of the fuel injectors 12 and the amount of heating by the heater 26 can be controlled at each cylinder, preferably, the amount of heating by the heater 26 is controlled at each cylinder based on the engine-restart-time injector ethanol concentration at the cylinder. If the heater 26 is provided in the delivery pipe 14, or if the heater 26 is provided for each fuel injector 12 and the amounts of heating by the heaters 26 are uniformly controlled, preferably, the amount of heating by the hearer 26 is controlled based on the lowest engine-start-time injector ethanol concentration among the engine-start-time injector ethanol concentrations. According to the control described above, it is possible to reliably avoid excessive heating by the heater 26 and thereby reliably prevent an engine start problem.

In the example embodiment described above, the blended fuel that contains ethanol and gasoline is used. However, the invention may also be applied to, for example, a case where blended fuel containing components other than ethanol and gasoline, such as methanol, ETBE (ethyl tertiary butyl ether), methylester, and diesel fuel is used.

in the example embodiment described above, the injector ethanol concentration corresponds to "injector fuel property value" in the invention, and the ECU 50 serves as "engine-restart-time fuel injection amount calculator" in the invention by executing the processes in the routine illustrated in FIG. 6, serves as "engine-restart-time fuel property value calculator" in the invention by executing the processes in Steps 102, 104, and 108, and serves as "fuel injection amount calculator" in the invention by executing the process in Step 112.

What is claimed is:

1. A control apparatus for an internal combustion engine operable on blended fuel that contains a plurality of components, comprising:

a delivery pipe through which the fuel is distributed to fuel injectors for multiple cylinders;

a fuel supply passage through which the fuel is supplied to the delivery pipe from a fuel tank in which the fuel is stored;

a fuel property sensor that is provided in the fuel supply passage, and that detects a component ratio of the fuel;

a fuel property value calculator that calculates an injector fuel property value for each of the cylinders, the injector fuel property value being a value related to the component ratio of the fuel near each of the fuel injectors, using the component ratio detected by the fuel property sensor a period of time ago, which is equal to an amount of time required for the fuel to travel from the fuel property sensor to each of the fuel injectors, as a value corresponding to the present component ratio of the fuel near the corresponding injector; and an engine-restart-time fuel injection amount calculator that calculates a fuel injection amount for each of the cylinders based on an engine-off duration that is a time period from stop of the internal combustion engine to restart of the internal combustion engine, in a case where the internal combustion engine is restarted after the internal combustion engine is stopped when the injector fuel property value calculated by the fuel property value calculator varies from cylinder to cylinder.

2. The control apparatus according to claim 1, wherein the engine-restart-time fuel injection amount calculator includes:

an engine-restart-time fuel property value calculator that calculates the injector fuel property value for each of the cylinders at restart of the internal combustion engine, based on the engine-off duration and the injector fuel property value for the corresponding cylinder, calculated before the internal combustion engine is stopped; and a fuel injection amount calculator that calculates the fuel injection amount for each of the cylinders based on the injector fuel property value for the corresponding cylinder at the restart of the internal combustion engine, calculated by the engine-restart-time fuel property value calculator.

3. The control apparatus according to claim 2, wherein if the engine-off duration is equal to or shorter than a predetermined value, the injector fuel property value calculated by the fuel property value calculator before the internal combustion engine is stopped is used as the injector fuel property value for the corresponding cylinder at the restart of the internal combustion engine.

4. The control apparatus according to claim 2, wherein the engine-restart-time fuel property value calculator calculates the injector fuel property value for each of the cylinders at the restart of the internal combustion engine, based on the engine-off duration and a concentration diffusion duration that is a predetermined time period required for the fuel property value of the fuel in the delivery pipe to become uniform.

5. The control apparatus according to claim 4, wherein if the engine-off duration is equal to or longer than the concentration diffusion duration, an average fuel property value of the fuel in the delivery pipe at stop of the internal combustion engine is used as the injector fuel property value for each of all the cylinders at the restart of the internal combustion engine.

6. The control apparatus according to claim 2, further comprising:

a heater that heats the fuel in the fuel injectors or the fuel in the delivery pipe;

an engine-restart-time heater activating unit that activates the heater to heat the fuel when the internal combustion engine is restarted; and a heating controller that controls an amount of heating performed by the heater when the internal combustion engine is restarted, based on the injector fuel property value for each of the cylinders at the restart of the internal combustion engine, calculated by the engine-restart-time fuel property value calculator.

7. A method for controlling an internal combustion engine that is operable on blended fuel that contains a plurality of components, and that is provided with a delivery pipe through which the fuel is distributed to fuel injectors for multiple cylinders, a fuel supply passage through which the fuel is supplied to the delivery pipe from a fuel tank in which the fuel is stored, and a fuel property sensor that is provided in the fuel supply passage and that detects a component ratio of the fuel, the method comprising:

calculating an injector fuel property value for each of the cylinders, the injector fuel property value being a value related to the component ratio of the fuel near each of the fuel injectors, using the component ratio detected by the fuel property sensor a period of time ago, which is equal to an amount of time required for the fuel to travel from the fuel property sensor to each of the fuel injectors, as a value corresponding to the present component ratio of the fuel near the corresponding injector; and calculating a fuel injection amount for each of the cylinders based on an engine-off duration that is a time period from stop of the internal combustion engine to restart of the internal combustion engine, in a case where the internal combustion engine is restarted after the internal combustion engine is stopped when the calculated injector fuel property value varies from cylinder to cylinder.

* * * * *